US005915846A

United States Patent [19]

Gillie

[11] Patent Number: 5,915,846

[45] Date of Patent: Jun. 29, 1999

[54] DRAIN APPARATUS WITH UNCLOGGING DEVICE

[76] Inventor: Trent Blaine Gillie, 7447 Kinchin Road, Prince George, British Columbia, Canada, V2K 3N3

[21] Appl. No.: 08/912,395

[22] Filed: Aug. 18, 1997

Related U.S. Application Data

[63] Continuation-in-part of application No. 08/593,384, Jan. 29, 1996, abandoned.

[51] Int. Cl.[6] ..... E03D 9/00

[52] U.S. Cl. ..... 4/255.01; 285/266

[58] Field of Search ..... 4/255.01; 403/141, 403/143; 285/266, 346; 277/609, 614, 626, 627

[56] References Cited

U.S. PATENT DOCUMENTS

| | | | |
|---|---|---|---|
| 267,306 | 11/1882 | Gall | 4/255.01 X |
| 1,795,811 | 3/1931 | White | 285/266 X |
| 2,111,200 | 3/1938 | Amourelle | 285/266 X |
| 2,477,762 | 8/1949 | Monroe | 285/266 |
| 2,576,640 | 11/1951 | Ramsey | 4/255.01 |
| 3,883,256 | 5/1975 | Schmidt | 403/141 |
| 4,568,216 | 2/1986 | Mizusawa et al. | 403/143 |
| 4,600,416 | 7/1986 | Mann | 55/323 |
| 5,123,627 | 6/1992 | Hodges | 251/146 |
| 5,249,311 | 10/1993 | Rau | 4/255.05 |
| 5,265,301 | 11/1993 | Irwin | 15/104.33 |
| 5,326,071 | 7/1994 | Gunness | 251/145 |
| 5,370,155 | 12/1994 | Gyongyossy | 137/630.12 |

*Primary Examiner*—Robert M. Fetsuga
*Attorney, Agent, or Firm*—Norman M. Cameron

[57] ABSTRACT

A drain apparatus includes a conduit and a compression fitting sealingly connected to the conduit having a pivotable member mounted thereon. There is a rod-like member extending slidably through the pivotable member into the conduit. The rod-like member can be moved axially and pivotally inside the conduit to clear obstructions therein. For example, the first conduit and the second conduit may be adjacent portions of an elbow. The pivotable member may be a ball-like member received in a socket in the fitting.

12 Claims, 3 Drawing Sheets

DRAIN APPARATUS WITH UNCLOGGING DEVICE

RELATED APPLICATION

This is a continuation-in-part of application Ser. No. 08/593,384 filed Jan. 29, 1996 now abandoned.

BACKGROUND OF THE INVENTION

This invention relates to drains having unclogging devices to facilitate the flow of liquids through the drains.

Drains are used for many purposes to remove liquids from holding tanks, conduits and the like. In some cases the drains are used to remove liquids which are capable of clogging the drains. One example is drains for black liquor holding tanks used in pulp mills. Conventionally such drains are often equipped with a ball valve and consist of a short vertical section of pipe extending downwardly from the black liquor holding tank. These often become clogged due to solid materials commonly deposited by black liquor. In the past these drains have been customarily unclogged by poking rods upwardly through the drains after the ball valves have been opened. This can pose a significant risk to workers because black liquor can cause chemical or thermal burns, particularly hazardous to workers' eyes. Sometimes the drain suddenly becomes unclogged, causing a surge of dangerous liquid to come out of the drain and spray nearby workers.

In addition there is a significant environmental risk using such conventional drains. The drains may appear clogged and therefore are left unattended after the ball valve is opened and before the obstruction is cleared. In the past this has caused serious accidents where black liquor suddenly makes its way through the drain and floods the surrounding area.

Accordingly it is an object of the invention to provide an improved drain apparatus with provision for unplugging the drain without posing a hazard to people operating the device or located nearby.

It is another object of the invention to provide an improved device of the type which accomplishes the task of unplugging drains better than prior art devices and methods.

It is a further object of the invention to provide an improved device of the type which is simple, rugged in construction and durable.

It is a still further object of the invention to provide an improved device of the type which can be installed on existing drain outlets or the like.

SUMMARY OF THE INVENTION

In accordance with these objects there is provided a drain apparatus which includes a first conduit. There is a compression fitting sealingly connected to the conduit having a pivotable member mounted thereon. A rod-like member extends slidably through the pivotable member into the conduit. The rod-like member can be moved axially and pivotally inside the conduit to clear obstructions therein.

The conduit may have a shut off valve therealong. The apparatus may have a second conduit extending away from the first conduit at an angle between the fitting and the valve. For example the first conduit and the second conduit may be adjacent portions of an elbow.

The fitting may have a socket with the pivotable member being a ball-like member received in the socket. The ball-like member may have an aperture slidably received on the rod-like member.

The invention potentially offers many significant advantages compared with prior art drain cleaning methods and apparatuses. Most significantly the drain clearing operation is performed without any substantial risk of contact between workers and liquids flowing through the drain which may be hot and/or corrosive. If necessary, the apparatus can be constructed of corrosion resistant materials. The rod-like member can be replaceable as in the embodiments described below.

BRIEF DESCRIPTIONS OF THE DRAWINGS

DESCRIPTION OF THE PREFERRED EMBODIMENTS

Figure 1:
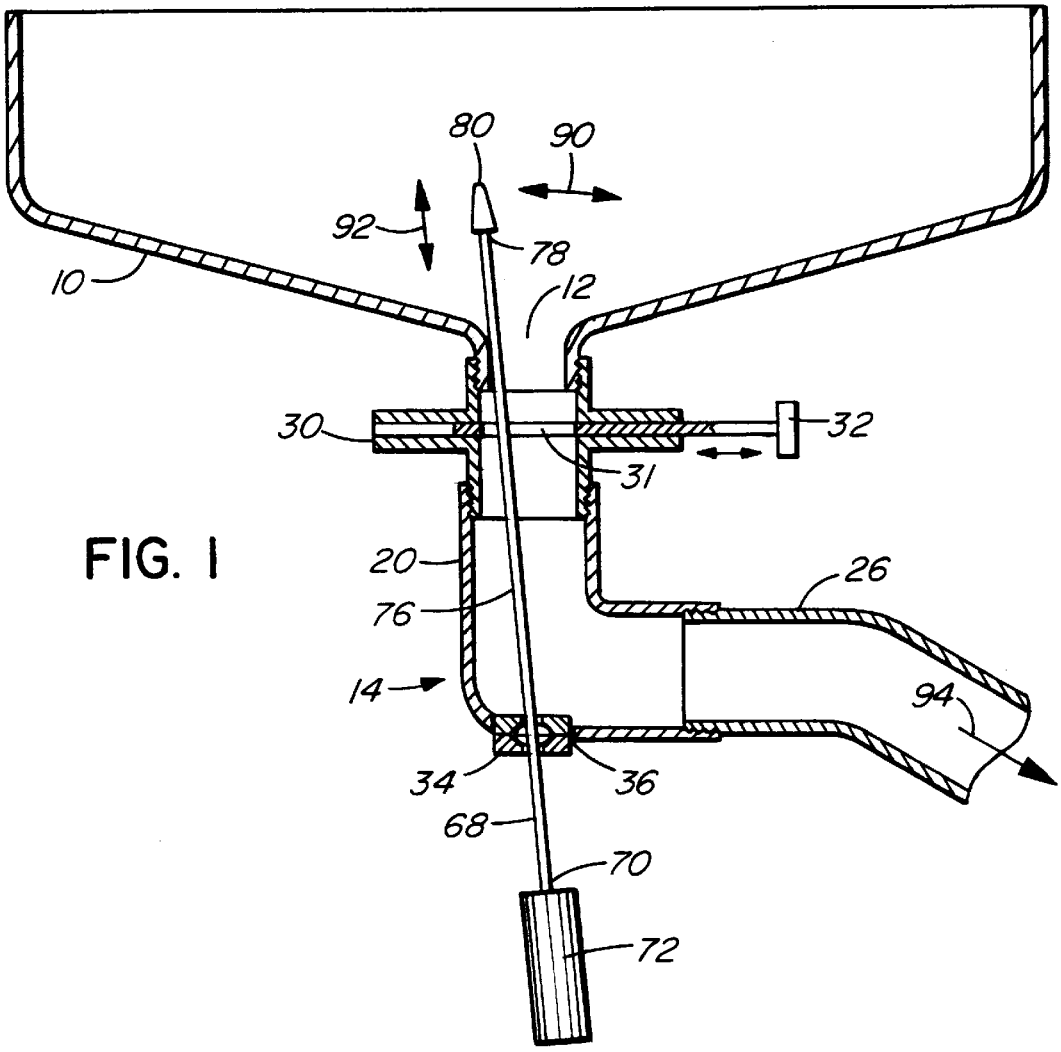
FIG. 1 is a sectional view of a holding tank with attached drain apparatus according to a first embodiment of the invention.

Referring first to FIG. 1, this shows a holding tank 10 which typically is used for retaining a liquid. For example it may be a holding tank for black liquor in a pulp mill. The bottom is slightly conical in this embodiment to provide draining through an aperture 12. There is a drain apparatus 14 connected to the tank 10 by means of male threads on the bottom of the tank about aperture 12 and female threads on the apparatus as described below.

Figure 3:
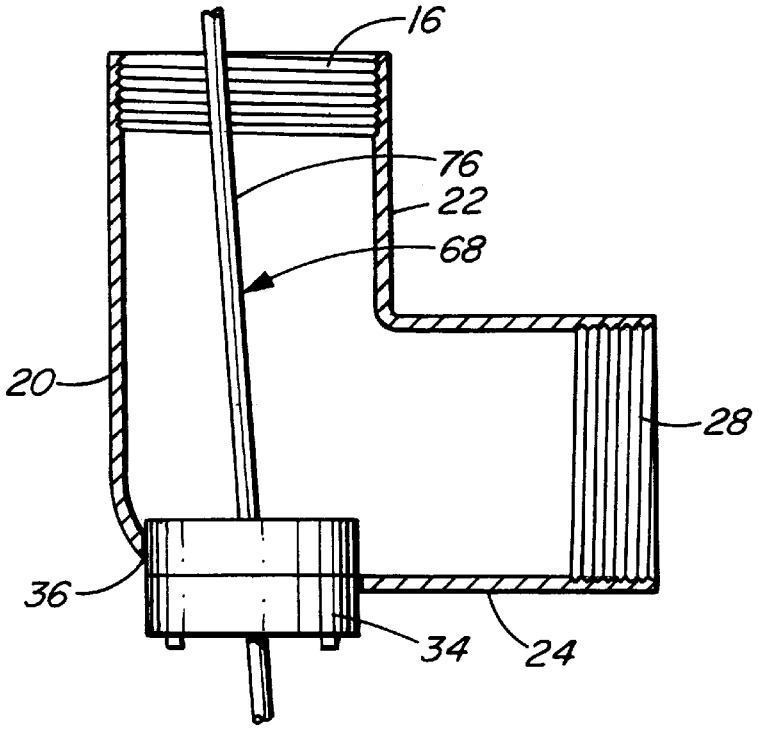
FIG. 3 is an enlarged, fragmentary view showing the elbow thereof in section and the rod-like member and fitting in elevation.
Figure 4:
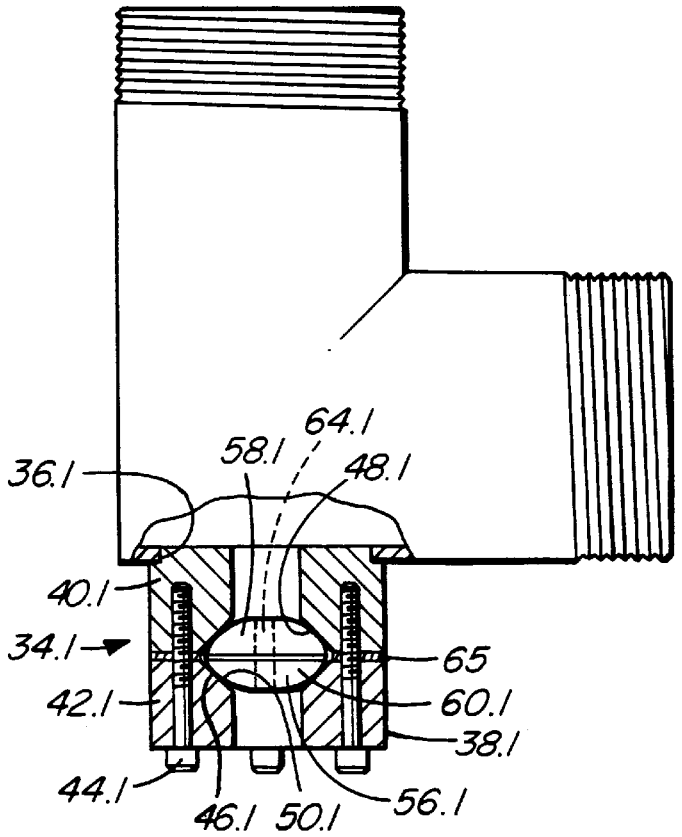
FIG. 4 is a view similar to FIG. 3 of a drain apparatus according to a second embodiment of the invention with the rod-like member removed.
Figure 5:
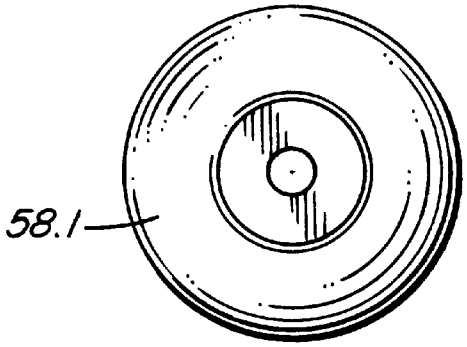
FIG. 5 is a top plan view of one of the PTFE seals of the compression fitting thereof.

The drain apparatus includes a body 20 in the form of an elbow formed by a first conduit 22 and a second conduit 24 shown in FIG. 3. The second conduit extends away from the first conduit at an angle, a right angle in this example. There is a discharge pipe 26 connected to the second conduit by means of female threads 28 on the conduit and corresponding male threads on the pipe. It should be understood that the various connections could be made in other ways, such as welding in alternative embodiments. It should also be understood that the second conduit 24 could be a separate pipe or other conduit instead of forming pair of the elbow as in the illustrated embodiment.

There is a valve 30, a gate valve in this example, connected to the first conduit 22 adjacent the top thereof by means of female threads 16 on the conduit and corresponding male threads on the valve. The valve has female threads which engage male threads on the bottom of the tank adjacent the opening 12. Again other alternative connection means could be used such as brazing or welding however.

Figure 2:
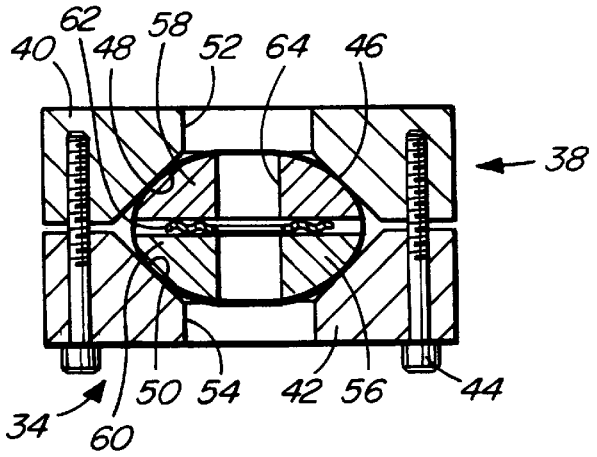
FIG. 2 is an enlarged sectional view of the fitting and pivotable member thereof.

There is a compression fitting 34 located within a corresponding aperture 36, circular in this example, in the bottom of the body 20. Welding or brazing, depending upon the materials, can be used to secure the fitting in place and provide a tight seal around the fitting. The fitting has a body 38, best shown in FIG. 2, having a upper annular portion 40 and a lower annular portion 42 connected together by a plurality of bolts 44. There is a socket 46 formed in the body 38 by frusto-conical recesses 48 and 50 in the annular portions 40 and 42 respectively. There is also a pair of aligned cylindrical apertures 52 and 54 in the annular portions which communicate with the recesses.

A ball-like member 56 is located within the socket 46 in a pivotable manner. It has an upper half 58 and a lower half 60 separated by a spring washer 62 in this example. The upper and lower halves are of PTFE in this embodiment although alternative materials could be substituted. It may be noted in the drawing that the socket and the ball-like member are flattened from top to bottom in this embodiment although other shapes including spheres could be substituted.

There is an aperture 64 extending through the ball-like member 56 which slidably receives a rod-like member 68 shown in FIG. 1 and FIG. 3. The rod-like member has a first end 70 located outside the body 20 and the interior of the conduits 22 and 24. A handle 72 is fitted to end 70. The rod-like member is straight in this example and has an interior portion 76 which extends inside the first conduit 22. The interior portion has an end 78 fitted with a blunt member 80 which is frusto-conical shaped in this embodiment with a rounded tip. Other shapes could be substituted depending upon requirements or this member 80 could be omitted entirely.

FIG. 4–7 show an elbow-shaped body 22.1 and a compression fitting 34.1 according to a second embodiment of the invention which is generally similar to the first embodiment and, accordingly, is only described with reference to the differences. Like parts have like numbers with the additional designation "1".

In this example there is an o-ring about aperture 64.1 of the member 56.1 which contracts the rod (not shown). The o-ring is between halves 58.1 and 60.1 and is of perfluroelastomer sold by DuPont Dow Elastomers under the trademark Kalrez in this example. The spring washer 62.1 is also between halves 58.1 and 60.1 of member 56.1 and extends about the o-ring. A gasket 65, of Gortex (trademark) in the embodiment, is compressed between the upper and lower annular portions 40.1 and 42.1 of body 38.1 by bolts 44.

Figure 6:
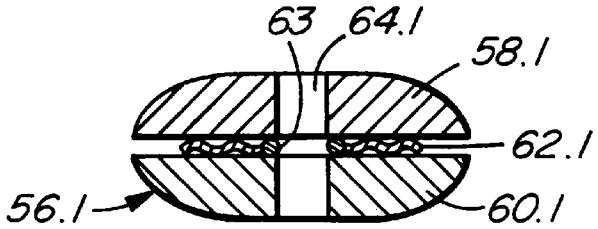
FIG. 6 is a sectional view of the PTFE seals, o-ring and spring washer of the compression fitting.
Figure 7:
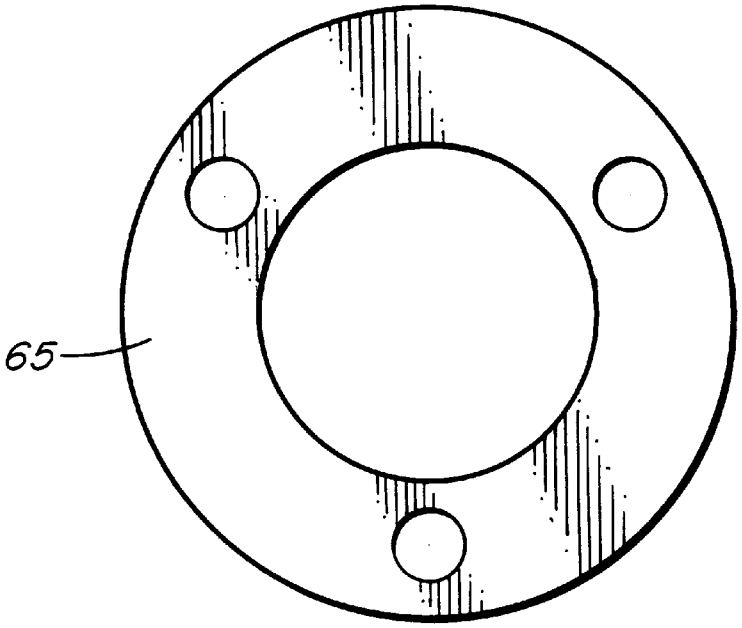
FIG. 7 is a top plan view of the gasket thereof.

In this example the member 56.1 is elliptical in section, as seen in FIG. 6, each half being semi-elliptical and being made of PTFE. The spring washer 62.1 is an SAI Series Disc Spring, available from Spae-Naur Inc. In this particular example.

Operation

Referring to the drawings, the valve 30 is normally closed with opening 31 of the valve moved to the left from the point of view of FIG. 1. This arrangement would be different depending upon the construction of the valve and its type. In the closed position liquid within the holding tank 10 is retained. When the valve is closed the rod-like member 68 is retracted away from the valve by pulling on handle 72 until the blunt member 80 is adjacent fitting 34.

Valve 30 of this embodiment is opened by pulling on handle 32 to align the opening 31 in the valve with opening 12 in the bottom of the tank and the interior of the first conduit 22. This normally allows liquid to flow downwardly through opening 12 through the first conduit into the second conduit and finally through the discharge pipe 26. However, the opening 12 in the bottom of the tank is subject to becoming plugged by debris or solid material in the tank for applications requiring such an apparatus. The rod-like member 68 is used to clear such debris or solid material after the valve is opened. The handle 72 can be pushed to force the rod-like member upwardly through the first conduit 22 and through opening 12 as seen in FIG. 1. As disclosed above, the rod-like member fits through the aperture 64 in the ball-like member 56 of the fitting 34. This allows the rod-like member to be pivoted or rotated to move it back and forth, for example, as indicated by arrows 90 of FIG. 1. In addition, the rod-like member can be pulled axially in and out as indicated by arrows 92. The enlarged, blunt end 80 further helps in breaking the barrier formed by debris or solid material at opening 12.

Once the blockage is cleared by using the rod-like member, the liquid is free to flow downwardly through the opening, reach the discharge pipe 26 and flow outwardly as indicate by arrow 94. Thus the liquid is deflected completely away from the body of a worker operating the apparatus by means of handle 72. The discharge pipe 26 can extend a considerable distance to some suitable location for receiving the liquid from the holding tank.

Thus it may be seen that the blockage can be cleared without any danger of spillage of liquid at all.

Sealing about the rod is assured by the special type of compression fitting used, particularly with reference to the embodiment of FIG. 4–7. Sealing about the o-ring is assured by compressing the two halves 58.1 and 60.1 of member 56.1 in the space 46.1 using bolts 44.1.

The spring washer 62.1, backed up by o-ring 63, maintains the halves 58.1 and 60.1 tightly against the body 38.

In the preferred embodiment the metallic components are stainless steel and Tig welding is used. However other materials may be substituted.

It will be understood by someone skilled in the art that many of the details described above can be altered or deleted without departing from the scope of the invention which is to be determined with reference to the following claims.

What is claimed is:

1. A drain apparatus comprising:

a first conduit;

a compression fitting sealingly connected to the conduit having a pivotable member mounted therein, the fitting having a body with an upper annular portion and a lower annular portion, each said portion having a frusto-conical shaped recess, the pivotable member being a ball-like member compressedly received in the recesses, the ball-like member having a seperate upper half and lower half, the upper half being in the recess of the upper annular portion and the lower half being in the recess of the lower annular portion, the ball-like member having an aperture therethrough;

a spring washer between the halves of the ball-like member, the washer having a central aperture; and a rod-like member extending slidably through the aperture in the pivotable member and the aperture of the spring washer and into the conduit, whereby the rod-like member can be moved axially, rotationally and pivotally inside the conduit to clear obstructions.

2. An apparatus as claimed in claim 1, wherein the conduit has a shut off valve therealong.

3. An apparatus as claimed in claim 2, wherein a second conduit extends away from the first conduit at an angle between the fitting and the valve.

4. An apparatus as claimed in claim 3, wherein the first conduit and the second conduit are adjacent portions of an elbow.

5. An apparatus as claimed in claim 1, wherein the rod-like member has a first end outside the conduit and a handle on the first end.

6. An apparatus as claimed in claim 1, wherein the rod-like member has an interior portion with a second end and a blunt member connected to the second end.

7. An apparatus as claimed in claim 6, wherein the blunt member frusto-conical in shape.

8. An apparatus as claimed in claim 1, where in the member is of PTFE.

9. An apparatus as claimed in claim 1, wherein the fitting has an o-ring about the rod, inside the aperture of the washer and between the halves of the ball-like member.

10. An apparatus as claimed in claim 9, wherein the o-ring is of a perfluroelastomer.

11. An apparatus as claimed in claim 1, wherein the ball-like member is elliptical in section, each half being semi-elliptical in section.

12. An apparatus as claimed in claim 1, wherein the portions of the body are connected by bolts, the ball-like member being compressed by tightening the bolts.

* * * * *